United States Patent [19]

Ciecior

[11] 4,372,230

[45] Feb. 8, 1983

[54] PRESSER FOOT WITH CORDING ATTACHMENT

[75] Inventor: Heinrich K. Ciecior, Ettlingen, Fed. Rep. of Germany

[73] Assignee: Union Special G.m.b.H., Stuttgart, Fed. Rep. of Germany

[21] Appl. No.: 228,512

[22] Filed: Jan. 26, 1981

[30] Foreign Application Priority Data

Feb. 1, 1980 [DE] Fed. Rep. of Germany ..... 3003630

[51] Int. Cl.[3] ..... D05B 29/12

[52] U.S. Cl. ..... 112/139; 112/151

[58] Field of Search ..... 112/139, 151, 136, 137, 112/235

[56] References Cited

U.S. PATENT DOCUMENTS

| | | | |
|---|---|---|---|
| 986,794 | 3/1911 | Alsop . | |
| 1,717,099 | 6/1929 | Dooley | 112/139 X |
| 2,003,665 | 6/1935 | Karle . | |
| 2,682,240 | 6/1954 | Knaus et al. . | |
| 2,737,914 | 3/1956 | Hofgesang | 112/139 |

FOREIGN PATENT DOCUMENTS 457752 3/1928 Fed. Rep. of Germany .

*Primary Examiner*—Werner H. Schroeder
*Assistant Examiner*—Andrew M. Falik
*Attorney, Agent, or Firm*—John W. Harbst; John A. Schaerli

[57] ABSTRACT

A sewing machine presser foot having a labyrinth like passageway for freely guiding a cord to the sewing area of the machine in a manner preventing the self unthreading of the cord.

6 Claims, 4 Drawing Figures

PRESSER FOOT WITH CORDING ATTACHMENT

FIELD OF THE INVENTION

This invention relates to sewing machines and, more particularly, to new and useful improvements in presser feet for sewing machines.

BACKGROUND OF THE INVENTION

Presser feet with cord attachments or guides are well known in the art of sewing. With most of the heretofore known guide attachments, the presser foot has a closed channel or groove for guiding the cord to the sewing area. Although these closed guide channels present a perfect guide, they make it, nevertheless, considerably difficult to thread the cord. This more difficult threading is, of course, a distinct disadvantage. The difficulty in threading a cord through a closed channel is especially apparent in overedge sewing machines where the channel is not easily accessible. Cording attachments on overedge machines are also prone to easily unthread when the presser foot is swung out.

BRIEF DESCRIPTION OF THE PRESENT INVENTION

The disadvantages of the heretofore known devices are essentially overcome by the present invention. The presser foot of the present invention is provided with an opening that easily enables the introduction and presentation of the cord to the sewing area of the machine. The cord is freely guided to the machine sewing area through a labyrinth like passageway or guide which guards against the unintentional unthreading of the cord from the presser foot. This guiding arrangement is of special advantage when the thread chain is repositioned at the end of the sewing machine to ensure its incorporation into subsequent sewing operations.

It is therefore a primary object of this invention to provide a presser foot with a cord guiding means which positions the cord relative to the stitching point so that the same may be properly secured to the workpiece.

Another object of this invention is to provide an improved sewing machine cord guiding means which, although most efficient in operation, is also inexpensive to manufacture.

Yet another object of this invention is to provide a cord guiding means which allows easy threading of the cord and prevents self unthreading of the cord.

With the above and other objects in view, as will hereinafter appear, the invention comprises the devices, combinations, and arrangements of parts hereinafter set forth and illustrated in the accompanying drawings of a preferred embodiment of the invention from which the several features of the invention and the advantages obtained thereby will be readily understood by those skilled in the art.

DETAILED DESCRIPTION OF THE PREFERRED EMBODIMENT

Figure 1:
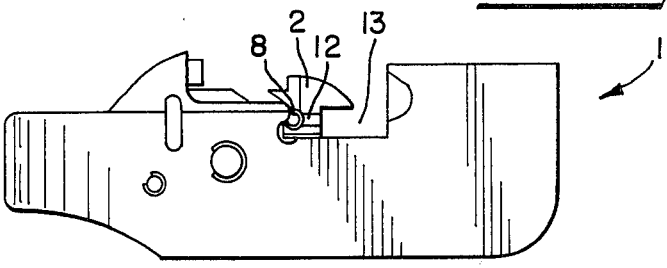
FIG. 1 represents a bottom plan view of the presser foot of the present invention.
Figure 2:
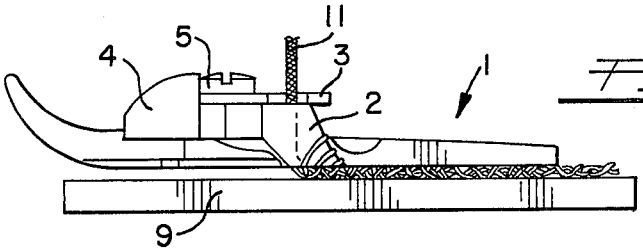
FIG. 2 represents a side elevational view of the presser foot.
Figure 3:
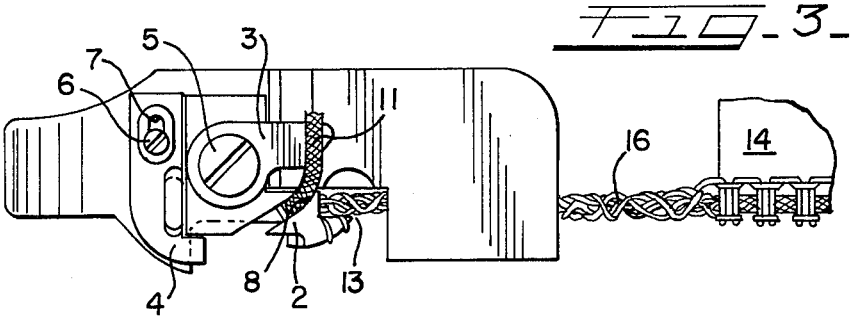
FIG. 3 represents a plan view of the pressure foot together with a sewn article having a cord secured to the edge with the usual thread chain.

Indicated at 1 in the drawings is an elongated presser foot section having a needle receiving aperture 13 defining the sewing area. With the exception of the illustrated throat plate 9, the mechanisms usually arranged in cooperation with the presser foot section have been deleted in the interest of accentuating the disclosure of this invention. Suffice it to say that any known loop taker mechanism may be adapted for cooperation with a needle to form a series of stitches in a workpiece as illustrated in FIG. 3.

In the embodiment of this invention selected for illustration, the foot section 1 is of the type adapted for use with an overedge sewing machine. Approximately midway its length, the elongated presser foot sole, on its upper surface, is channeled at right angles to the length of the sole. In the usual manner, a projection (not shown) extending from the side of the presser arm (not shown) is adapted to fit into this channel. The channel may be semi-circular in cross section but is of somewhat less depth than the radius of the presser arm projection in order that the presser foot may rock upon said projection.

The presser arm projection may be held in the channel by the free end of a cap 3. The cap 3, which may be in the form of a spring, is secured to the presser foot in advance of the channel by a screw 5. The screw 5 also serves to removably mount a block means 2 to the sole plate. A portion of the block means 2 overhangs the longitudinal side portion of the presser foot section. The overhanging portion of the block means 2 has a sole portion which is flush with, and acts as an extension of, the bottom of the presser foot section. At its free end, the block means 2 is provided with a chaining-off finger which is disposed in a transverse spaced relation with the longitudinal side portion of the presser foot sole section. It is around this finger that the overseam stitches are formed and from off the end of which they slip as the work is fed through the machine. Forward of the block means 2, the presser foot assembly is provided with a guide 4. The guide 4 may be secured to the forward end of the foot by a screw 6. A longitudinal channel 7 in the guide 4 allows it to be set in any of a plurality of positions.

In the preferred embodiment, the presser foot section is provided with a cord guiding passageway 8 arranged adjacent the needle receiving aperture 13. It is the function of this channel or passageway to permit a cord 11 to be introduced along the edge of the workpiece. In the preferred embodiment, the passageway is formed as an integral part of the block means 2. The passageway 8 is an open sided guideway which, as seen in the drawings, opens to the outerside face of the block means 2 for purposes of easy threading. The entranceway and exitway of the cord guideway 8 are offset relative to one another. The entrance end is disposed at the upper surface of the presser foot section 1 while its lower or exit end is provided at the lower surface of the block means 2 so that it will break through the bottom of the presser foot section. That is, a first portion of the passageway 8 is arranged with a generally vertical plane extending generally perpendicular to the presser foot sole while a second portion of the passageway extends transverse to the first portion and to the sole plate and opens at a position offset from the inlet end. In this manner, the cord passes over or through a labyrinth like path which acts to prevent the self unthreading of the cord from the passageway.

Figure 4:
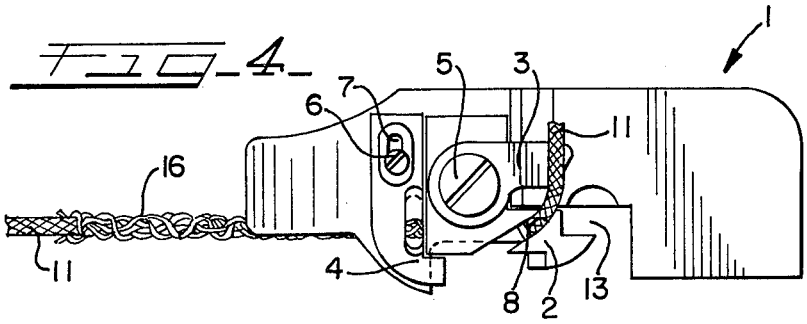
FIG. 4 represents a view similar to FIG. 3 except with the chain and cord drawn to the front of the foot.

As seen in the drawings, the cord 11 is conducted generally vertical through a first portion of the passageway and subsequently proceeds through a second portion of the passageway from whence it is guided along guide 12 to the stitch forming area of the machine. The second portion being offset from, but contiguous with, the first portion and is directed toward the stitch forming area. During sewing of workpiece 14, the cord is sewn into the overedge seam and lies securely along the edge of the workpiece. When the thread chain and cord are returned toward the operator (FIG. 4) against the direction of feed so as to allow the chain to be sewn into the subsequent sewing operation, the design of the cord passageway prevents self unthreading of the cord 11 from the passageway. In this manner, the operator need not spend valuable time rethreading the cord each time the foot is swung away from the sewing area.

It will be appreciated by those skilled in the art, that the present invention provides a most simple but yet efficient means for guiding a cord to the stitching area of the machine while preventing self-unthreading of same. With the present invention, the stitch finger block incorporates therein not only the usual chaining of the finger, but is also provided with a labyrinth like passageway. Such passageway functions to freely guide a cord to the stitching area such that the cord will be guided in a predetermined manner relative to the chain-off finger and also guards against the self unthreading of the cord. In the event that cords of various diameters are to be employed, it is at once obvious that the pressure foot of present invention is easily accomodative of such changes. That is, the present presser foot may be provided with any number of block means which may incorporate guide passageways of various sizes. Thus, it is not necessary to provide a special presser foot in order to accomodate various types of cords for it is merely necessary to provide various block means having guideways of the desired size. Thus, the present invention provides a most inexpensive means for guiding cords to a pressure foot in a most efficient manner.

Thus, it is apparent that there has been provided, in accordance with the invention, a Presser Foot for Sewing Machines that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim the following:

1. A cording presser foot for overedge sewing machines comprising:

work engaging sole plate means having a needle opening, a cord guiding channel arranged proximate to and in advance of the needle opening in the direction of sewing permitting a cord to be guided toward the needle opening, and an opening extending from one lateral side of the sole plate to the channel by a labyrinth.

2. A sewing machine presser foot comprising:

work engaging sole plate means having a needle receiving aperture defining a sewing area, an opening in said sole plate means defining a cord guiding passageway arranged in advance of and adjacent the sewing area in the direction of sewing permitting a cord to be introduced along the edge of a workpiece, and a threading slot contiguously extending from said passageway to one lateral edge of said sole plate means, said threading slot having an entrance and exit so arranged with respect to each other that the self unthreading of the cord is prevented.

3. A sewing machine pressure foot comprising:

foot portion means having a needle receiving aperture defining a sewing area, a passageway formed adjacent to and in advance of the needle receiving aperture in the direction of sewing for guiding a cord to said sewing area, and a labyrinthian formed threading slot contiguously extending from said passageway to one lateral edge of said foot portion means whereby preventing the self unthreading of the cord.

4. The pressure foot of claim 3 wherein said foot portion means includes an elongated sole plate means and a block removably mounted upon said sole plate means, said block means having a chain-off finger arranged at one extremity thereof and having said passageway formed therein.

5. A sewing machine presser foot comprising:

an elongated sole plate having a needle receiving aperture defining a sewing area; and a block removably mounted upon the sole plate and having a chaining finger formed as an integral part thereof, said block further includes a cord guiding passageway having contiguous ingress and egress passageways extending from said cord guiding passageway to one lateral edge of said block, said ingress and egress passageway being formed to prevent self unthreading of the cord from the block.

6. A sewing machine presser foot for an overedge sewing machine comprising:

elongated work engaging sole plate section means having a needle receiving aperture, a chaining off finger disposed in transverse spaced relationship with one longitudinal side portion of said sole plate section means, a cord guiding passageway formed in said work engaging sole plate section means adjacent said chaining finger, and a thread slot for said guiding passageway opening to one lateral side of said work engaging sole plate section means along a labyrinthian path.

* * * * *